US005738401A

United States Patent [19]

Fan

[11] Patent Number: 5,738,401

[45] Date of Patent: Apr. 14, 1998

[54] PALM-PROTECTOR: HAND GRIP FOR SHOPPING BAGS AND PACKAGES

[76] Inventor: George S. Fan, 32 Quidnic Rd., Newton, Mass. 02168

[21] Appl. No.: 505,675

[22] Filed: Jul. 21, 1995

[51] Int. Cl.[6] ..... A45F 5/10; B65D 33/06

[52] U.S. Cl. ..... 294/171; 294/137

[58] Field of Search ..... 294/137, 153, 294/165–167, 170, 171; 16/110 R, 114 R, 114 B, 116 R; 229/117.09, 117.19; 383/6, 13, 17, 25, 26, 29

[56] References Cited

U.S. PATENT DOCUMENTS

| | | | |
|---|---|---|---|
| 1,793,575 | 2/1931 | Williams | 294/171 X |
| 2,846,714 | 8/1958 | Charlick | 294/171 X |
| 3,083,366 | 3/1963 | Franges | 294/171 |
| 3,800,361 | 4/1974 | Stauffer | 294/171 X |
| 3,913,172 | 10/1975 | Richards | 16/114 B |
| 4,556,245 | 12/1985 | Gruenwald | 294/170 X |
| 4,796,940 | 1/1989 | Rimland | 294/171 |
| 4,890,355 | 1/1990 | Schulten | 294/171 X |
| 4,902,060 | 2/1990 | Nobakht | 294/171 |
| 5,083,825 | 1/1992 | Bystrom et al. | 294/171 |
| 5,257,845 | 11/1993 | McConnell | 294/171 |
| 5,364,148 | 11/1994 | Bartocci | 294/171 |

FOREIGN PATENT DOCUMENTS

| | | | |
|---|---|---|---|
| 3821179 | 12/1989 | Germany | 294/171 |
| 5201453 | 8/1993 | Japan | 294/171 |
| 2153213 | 8/1985 | United Kingdom | 294/171 |
| 2237733 | 5/1991 | United Kingdom | 294/171 |

*Primary Examiner*—Johnny D. Cherry
*Attorney, Agent, or Firm*—Richard L. Miller, P. E. Registered Patent Agent

[57] ABSTRACT

A detachable bag-carrying handgrip device for hand carrying a shopping bag by its handles which due to the wide distribution of the carried weight over the fingers of the carrying hand is more comfortable to use than previous such devices. The hand grip comprises a flexible outer casing with two flexible edges for insertion of the carrying straps of the grocery bag to be carried. Upon insertion of the carrying straps, the carrying straps settle into a rigid channel which is open at the top and which provides the rigidity for a handgrip which is to be used to carry heavy shopping bags or packages for long distances. Due to this construction of the hand-grip, it remains with the straps of the carried bag even when the bag is set down.

6 Claims, 1 Drawing Sheet

FIG. 1
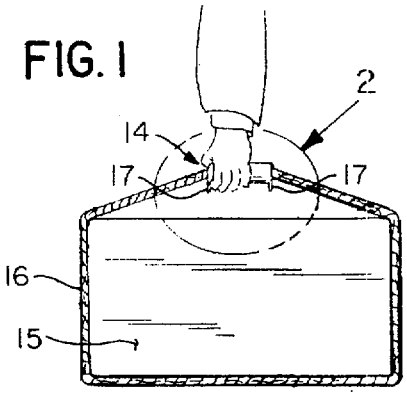
FIG. 2
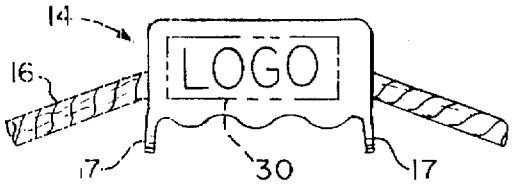
FIG. 3
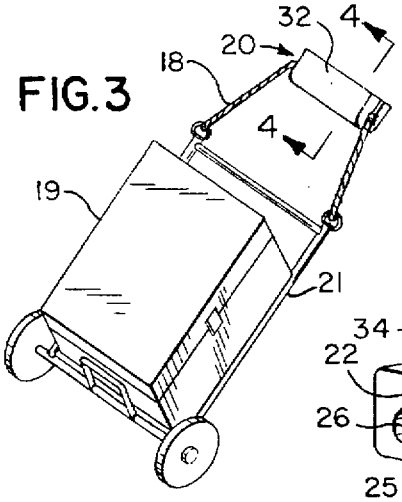
FIG. 4
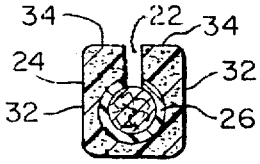
FIG. 5
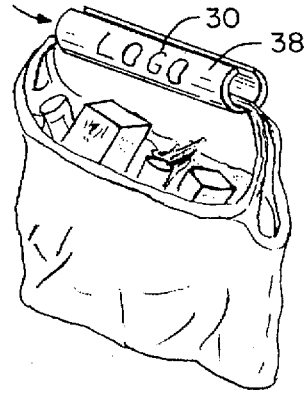
FIG. 6
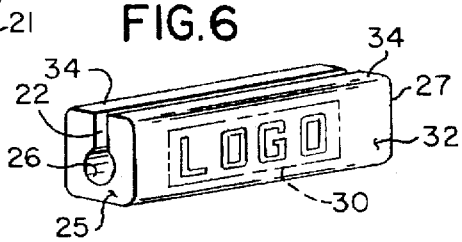
FIG. 7
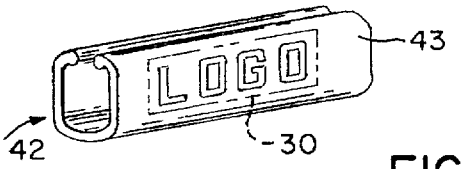
FIG. 8
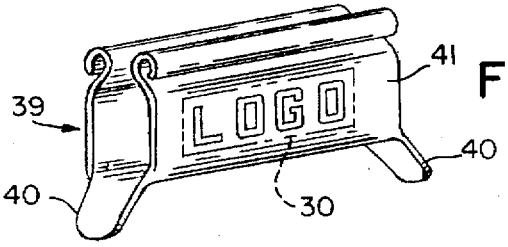
FIG. 9
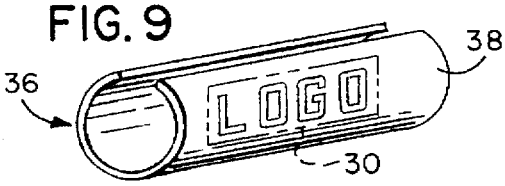
FIG. 10
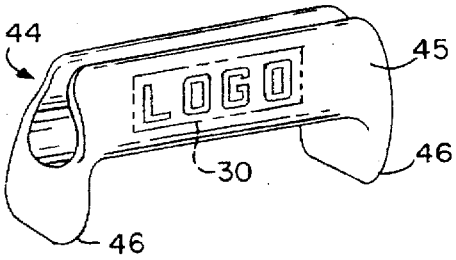
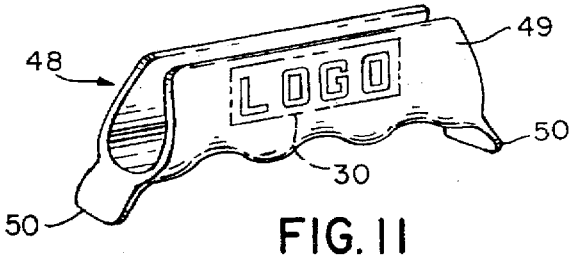
FIG. 11

PALM-PROTECTOR: HAND GRIP FOR SHOPPING BAGS AND PACKAGES

BACKGROUND OF THE INVENTION

The present invention relates to a readily applicable and removable hand grip for shopping bags and packages, and more particularly to a hand grip which is especially comfortable in use and which remains on the shopping bag or package when the bag or package is set down.

DESCRIPTION OF RELATED ART

Various bag-carrying handle grips are known. For example, reference is made to U.S. Pat. No. 3,913,172 to Richards which shows a hand grip with a cover which lids over the mouth portion of the hand-grip and snaps open to receive the carrying straps of a shopping bag and snaps closed to secure the bag straps. Since the hand grip is made of a rigid material it would quickly become uncomfortable to use if a bag or package had to be carried thereby for a long distance. In addition it may be a nuisance opening and closing the cover of the grip especially on a cold day when one is wearing gloves since one would probably have to remove his gloves to snap the cover open or closed.

A disposable hand grip for use with plastic bag loop handles is described in U.S. Pat. No. 4,796,940 to Rimland. The invention disclosed therein provides an attachable and detachable hand-grip, useful in conjunction with plastic bag loop handles, having a flexible plastic rectangular planar configuration. The hand-grip is bendable to a V-shaped configuration along a central axis, and after securing the bag handles, the bent portions are locked together by an attached fastening element. Due to its construction, however, this grip would only be useful for carrying lightweight bags for short distances. If it were attempted to use this hand grip with a heavy package, the weight of the package would primarily be applied to the fingers of the carrying hand along the fold where the hand-grip was longitudinally bent (i.e., along the central axis of the V). This would drive the point of the V of the hand-grip into the carrying hand, thus causing great discomfort.

A detachable bag-carrying handgrip is described in U.S. Pat. No. 4,902,060 to Nobakht. The invention disclosed therein provides a detachable bag-carrying handgrip device for hand-carrying one or more bags by their handle portion. The handgrip portion comprises an elongated handle which has an open top end for receiving a bag handle. A pair of retaining flanges are provided at opposite ends of the handle member. Each flange has a slot leading to an opening capable of accommodating one or more bag handles passing therethrough. Due to the flexible material with which such a hand-grip is made, again, a disproportionate amount of pressure will be placed on the fingers of the carrying hand at the peak or apex of the fold when the hand-grip is used to carry a heavy shopping bag.

None of these inventions provide a hand grip which provides the flexibility of a soft material with the nondeformability of a rigid material (useful when carrying a very heavy bag for long distances). Each of the background art devices either does not remain on the bag-handle when the bag is set down or is somewhat difficult to attach and detach at the commencement or termination of use.

SUMMARY OF INVENTION, OBJECTS AND ADVANTAGES

Accordingly, the above mentioned problem is obviated by the present invention which provides an easily attachable and detachable hand-grip which provides exceptional strength for carrying heavy bags and packages and yet provides great comfort to the fingers of the carrying hand. Due to its exceptional rigidity, the weight is evenly distributed over a greater surface area of the hand thus avoiding the white lines which appear in the carrying hand (where circulation in the hand was cut off) when the background hand-grips are used to carry heavy bags and packages. Further this new and improved hand-grip remains on the carrying handle of a bag or on the strap or string of a package even when the package is set down. Further the hand-grip can easily be attached or removed even when wearing gloves in cold weather. Finally, in one of the preferred embodiments, the hand-grip is provided with short downwardly pointing projections at either end thereof to provide proper finger clearance when the hand-grip is being used to carry a tightly tied package. The projections also provide further protection for the fingers if the bag or package should swing back and forth while being carried.

It is therefore an object of the present invention to provide a hand-grip with exceptional rigidity yet with great comfort in use. The hand-grip should be soft and present lots of surface area to the carrying hand to evenly distribute the weight of the carried bag or package over as wide an area as possible of the carrying hand. But the hand grip should present a rigid inflexible surface to the carrying straps or twine of a bag or package.

A second object of this invention is to provide a hand-grip which is easily attached and detached and yet remains with the handle, strap, or string of the bag or package it is being used to carry, even when the bag or package is set down.

A third object of this invention is to provide a hand-grip with suitable side-walls for the display of a logo, insignia, or advertising message.

A fourth object of this invention is to provide a hand-grip with projections or shields at either end thereof to provide further protection for the fingers if the bag or package being carried should swing back and forth while being carried and also to provide ample clearance for the fingers if a tightly tied package is being carried.

Further scope of applicability of the present invention will become apparent from the detailed description given hereafter. However, it should be understood that the drawings and the detailed description, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a diagrammatic perspective view illustrating a first embodiment of the instant invention being used to carry a package tied with rope.

FIG. 2 is an enlarged elevational view with parts broken away illustrating the invention in the area indicated by the dotted encirclement of arrow 2 in FIG. 1 in greater detail.

FIG. 3 is a diagrammatic perspective view illustrating the second and most preferred embodiment of the instant invention being used to pull a wheeled luggage carrier.

FIG. 4 is an enlarged cross sectional view with parts broken away taken on line 4—4 of FIG. 3.

FIG. 5 is a diagrammatic perspective view illustrating a third and less preferred embodiment of the instant invention being used to carry a shopping bag.

FIG. 6 is an enlarged diagrammatic perspective view of the most preferred embodiment per se.

FIG. 7 is an illustration of another variation.

FIG. 9 illustrates the embodiment of the present invention shown in FIG. 5.

FIGS. 8, 10, and 11 are illustrations of three other different intermediately preferred embodiments of the instant invention.

DESCRIPTION OF PREFERRED EMBODIMENT

Referring to the various drawings, FIG. 1 illustrates a first embodiment of the instant invention, generally shown as numeral 14, being used to carry a package 15 tied with a rope 16. Two projections 17 downwardly projecting from the instant invention provide further protection for the hand of the carrier.

FIG. 2 is an enlarged elevational view with parts broken away illustrating the invention in the area indicated by the dotted encirclement of arrow 2 in FIG. 1 in greater detail. In this drawing the logo 30 on the side of the hand grip can be clearly seen.

FIG. 3 shows the most preferred embodiment of the instant invention, generally shown as numeral 20, being used to pull a wheeled luggage carrier 21 by means of rope 18. The luggage, itself, is shown as numeral 19. The large surface area of the elongated sidewall 32 provides ample protection for the hand of the carrier.

FIG. 4 is an enlarged cross sectional view with parts broken away taken on line 4—4 of FIG. 3. As shown by FIG. 4, the elongated outer flexible shell of the hand-grip (generally shown as numeral 24) is preferably made of a resilient plastic type foam. The plastic type foam material, being soft and flexible, acts as a cushion for the hand of the person carrying a bag or package by distributing the bag or package weight more evenly over the fingers and palm of the carrier's hand. Running lengthwise along the upper surface of the outer flexible shell (generally shown as numeral 24) are two flexible edges 34 which define a narrow opening 22 for the reception of the hand straps of a plastic bag or the string or rope of a tied package. Within the opening and running the length of the outer flexible shell 24 is a sturdy, inflexible circular channel 26 which is open at the top and both the front end and the rear end for the reception of hand-bag straps or string. As can be seen from FIG. 6, this circular channel has the same length as the outer flexible shell and has a first end which opens onto the front surface 25 of the outer flexible shell and a second end which opens onto the rear surface 27 of the outer flexible shell. Depending upon the particular material chosen for the circular channel 26 and the resilient plastic type foam, bonding between the two may be accomplished by utilizing an adhesive; ultrasonic techniques; or just a frictional fit may suffice in some cases.

FIG. 6, which is an enlarged diagrammatic perspective view of the preferred embodiment of FIG. 3, displays that the opening 22 runs the length of the upper surface of the outer flexible shell and provides access to the circular channel 26 which is open at the top for the reception of hand-bag straps or rope or string. Since the opening 22 is narrower than handbag straps, once the handbag straps have been forced into this opening, they then settle into the inflexible channel 26. (It should be noted that since the flexible pliable material of the molded foam portion of the hand-grip has "memory", once the two edges 34 surrounding the opening 22 have been forced apart by the action of inserting the hand straps of a shopping bag, and the straps have further been forced down into channel 26, the two edges 34 move together again and cause the hand-grip to remain attached to the hand straps even after the shopping bag has been set down.) Upon the hand-grip being lifted, the flexible outer shell 24 of the hand-grip provides wide surface area to the carrying hand and thus such a distribution of the weight of the carried object that even heavy objects can be carried for long distances without cutting off circulation in parts of the fingers as is the case with most of the background art hand-grips. Further upon setting the carried object on the ground, the hand-grip still firmly captures the handbag strap, due to the narrowness of the opening 22. FIG. 6 also shows an idicia such as logo 30 on the elongated sidewall 32 of the hand-grip.

FIGS. 5, 7, and 9 show variations of a third and less preferred embodiment of the instant invention. These particular embodiments lack the flexible pliable material surrounding an inflexible channel as shown in FIG. 3 of the most preferred embodiment. In FIGS. 5, 7, and 9, the instant invention is generally shown by arrow 36. In each of these embodiments, a logo 30 is shown on the sidewall 38 of the hand grip 36.

FIGS. 8, 10, and 11 show intermediately preferred embodiments, generally shown as arrow 39, 44, 48 respectively with projections or strap stops 40, 46, 50, respectively at either end of the hand-grip to protect the fingers of the carrying hand from the hand straps of a carried bag in the event that the carried bag is swung back and forth while being carried. The projections 40, 46, 50, respectively also provide clearance for the fingers when the hand-grip 39, 44, 48, respectively are used to carry a tightly tied package with little clearance between the strings tied around the package and the outer surface of the package. In each of these embodiments, a logo 30 is shown on the sidewall 41, 49, respectively of the hand grip 39.

The U-shape of each of these embodiments allows the loops of plastic shopping bags or the strings tied around other types of packages to hang at the bottom of the U. In each of the above embodiments, the U-shaped hand grip will be sufficiently shaped and sized to fit comfortably in the fingers and palm of the carrying hand. The actual cross-section of the U-shape will vary with the choice of material. Some of the possible cross-section configurations are as follows:

(a) A resilient foam plastic (the embodiment of FIGS. 3, 4, and 6)

(b) hard plastic or metal (the embodiments of FIGS. 2, 5, and 7–11)

(c) cardboard (the embodiments of FIGS. 5, 7, and 9)

The shape of the handgrip can also be modified as required to suit automated needs for varied packaging and/or manufacturing requirements.

Those who are skilled in the art will understand that other variations can be made to the depicted hand-grips without departing from the spirit and scope of the instant invention.

CONCLUSION, RAMIFICATIONS, AND SCOPE OF INVENTION

From the foregoing, it will be seen that I have provided a hand-grip which is not only more comfortable to use than any of the background art, but also provides, in some of the embodiments, projections or strap stops to protect the fingers in the event that the carried object is swung while being carried. Further the instant invention easily attaches and detaches from inserted hand straps or string or rope and remains attached to the hand straps or handles of a shopping bag even after the handbag is set down.

Thus the reader will see that my invention supplies a long felt need for a comfortable, easy to use hand-grip which can be used to carry heavy shopping bags or packages for long distances and stays with the straps or strings of the carried object even when the carried object is set down. It will be understood by those skilled in the art that there are many variations of this hand-grip which can be made without departing from the inventive concepts expressed herein. Accordingly, the scope of my invention should be determined not by the embodiments described, but by the appended claims and their legal equivalents.

The invention claimed is:

1. A shopping package carrying hand grip replaceably attachable to at least one of hand straps of a package, a string of a tied package, and a rope of a tied package, that prevents injury to a palm of a shopper when the shopper is carrying the package regardless if said shopping package carrying hand grip is rotated longitudinally, comprising:

a) a one-piece, elongated, and rectangular-parallelepiped-shaped outer shell of a soft, flexible material; said one-piece, soft, flexible, elongated, and rectangular-parallelepiped-shaped outer shell having a length, an approximate longitudinal centerline, a pair of flat, opposing and parallel longitudinal faces, a flat front face with a top edge, a flat back face disposed behind, and parallel to, said flat front face of said one-piece, soft, flexible, elongated, and rectangular-parallelepiped-shaped outer shell and having a top edge; said one-piece, soft, flexible, elongated, and rectangular-parallelepiped-shaped outer shell further having a flat top face extending perpendicularly from said top edge of said flat front face of said one-piece, soft, flexible, elongated, and rectangular-parallelepiped-shaped outer shell to said top edge of said flat back face of said one-piece, soft, flexible, elongated, and rectangular-parallelepiped-shaped outer shell and having a longitudinal centerline; said one-piece, soft, flexible, elongated, and rectangular-parallelepiped-shaped outer shell further having a circular-cylindrically-shaped throughbore extending longitudinally therethrough, along said approximate longitudinal centerline of said one-piece, soft, flexible, elongated, and rectangular-parallelepiped-shaped outer shell from, and opening into, said flat front face of said one-piece, soft, flexible, elongated, and rectangular-parallelepiped-shaped outer shell to, and opening into, said flat back face of said one-piece, soft, flexible, elongated, and rectangular-parallelepiped-shaped outer shell; said one-piece, soft, flexible, elongated, and rectangular-parallelepiped-shaped outer shell further having a narrow and rectangular-parallelepiped-shaped throughslot for guiding reception of the at least one of the hand straps of the package, the string of the tied package, and the rope of the tied package into said one-piece, soft, flexible, elongated, and rectangular-parallelepiped-shaped outer shell; said narrow and rectangular-parallelepiped-shaped throughslot of said one-piece, soft, flexible, elongated, and rectangular-parallelepiped-shaped outer shell extending perpendicularly downwardly from, and opening into, said longitudinal centerline of said flat top face of said one-piece, soft, flexible, elongated, and rectangular-parallelepiped-shaped outer shell to, and opening into, said circular-cylindrically-shaped throughbore of said one-piece, soft, flexible, elongated, and rectangular-parallelepiped-shaped outer shell; said narrow and rectangular-parallelepiped-shaped throughslot of said one-piece, soft, flexible, elongated, and rectangular-parallelepiped-shaped outer shell further extending from, and opening into, said flat front face of said one-piece, soft, flexible, elongated, and rectangular-parallelepiped-shaped outer shell to, and opening into, said flat back face of said one-piece, soft, flexible, elongated, and rectangular-parallelepiped-shaped outer shell and being defined by a pair of flat, opposing, and parallel faces being parallel to, and disposed between, said pair of flat, opposing, and parallel longitudinal faces of said one-piece, soft, flexible, elongated, and rectangular-parallelepiped-shaped outer shell; and b) a one-piece, sturdy, inflexible, hollow, and circular-cylindrically-shaped inner tubular member being fixedly contained in said circular-cylindrically-shaped throughbore of said one-piece, soft, flexible, elongated, and rectangular-parallelepiped-shaped outer shell; said one-piece, sturdy, inflexible, hollow, and circular-cylindrically-shaped inner tubular member having a length equal to said length of said one-piece, soft, flexible, elongated, and rectangular-parallelepiped-shaped outer shell, a circular-cylindrically-shaped outer surface being fixedly attached to, and coincident with, entire said circular-cylindrically-shaped throughbore of said one-piece, soft, flexible, elongated, and rectangular-parallelepiped-shaped outer shell, a circular-cylindrically-shaped inner surface being concentric with, and inward of, said circular-cylindrically-shaped outer surface of said one-piece, sturdy, inflexible, hollow, and circular-cylindrically-shaped inner tubular member, an open front face being co-planar with said flat front face of said one-piece, soft, flexible, elongated, and rectangular-parallelepiped-shaped outer shell, an open back face being co-planar with said flat back face of said one-piece, soft, flexible, elongated, and rectangular-parallelepiped-shaped outer shell; said one-piece, sturdy, inflexible, hollow, and circular-cylindrically-shaped inner tubular member further having a narrow and rectangular-parallelepiped-shaped throughslot for guiding the reception of the at least one of the hand straps of the package, the string of the tied package, and the rope of the tied package, into said one-piece, sturdy, inflexible, hollow, and circular-cylindrically-shaped inner tubular member; said narrow and rectangular-parallelepiped-shaped throughslot of said one-piece, sturdy, inflexible, hollow, and circular-cylindrically-shaped inner tubular member extending along said length of, and radially from, and opening into, said circular-cylindrically-shaped outer surface of said one-piece, sturdy, inflexible, hollow, and circular-cylindrically-shaped inner tubular member to, and opening into, said circular-cylindrically-shaped inner surface of said one-piece, sturdy, inflexible, hollow, and circular-cylindrically-shaped inner tubular member and being defined by a pair of flat, parallel, and opposing faces being co-planar and continuous with said pair of flat, parallel, and opposing faces of said narrow and rectangular-parallelepiped-shaped throughslot of said one-piece, soft, flexible, elongated, and rectangular-parallelepiped-shaped outer shell, so that the at least one of the hand straps of the package, the string of the tied package, and the rope of the tied package can contact and force apart said pair of flat, opposing, and parallel faces of said narrow and rectangular-parallelepiped-shaped throughslot of said one-piece, soft, flexible, elongated, and rectangular-parallelepiped-shaped outer shell, and then be readily and easily guided into said narrow and rectangular-parallelepiped-shaped throughslot of said one-piece, soft, flexible, elongated, and rectangular-parallelepiped-shaped outer shell, and then be readily and easily guided into said narrow and rectangular-parallelepiped-shaped throughslot of said one-piece, sturdy, inflexible, hollow, and circular-cylindrically-shaped inner tubular member, and thereby allow said pair of flat, opposing, and parallel faces of said narrow and rectangular-parallelepiped-shaped throughslot of said one-piece, soft, flexible, elongated, and rectangular-parallelepiped-shaped outer shell to close, and then readily and easily seek a lowest point on said circular-cylindrically-shaped inner surface of said one-piece, sturdy, inflexible, hollow, and circular-cylindrically-shaped inner tubular member as a result of gravity and thereby protecting the palm of the shopper from injury caused by the at least one of the hand straps of the package, the string of the tied package, and the rope of the tied package when the shopper is carrying the package regardless if said shopping package carrying hand grip is longitudinally rotated since said sturdy, inflexible, hollow, and circular-cylindrically-shaped inner tubular member contacts entire of said circular-cylindrically-shaped throughbore of said soft, flexible, elongated, and rectangular-parallelepiped-shaped outer shell and said narrow and rectangular-parallelepiped-shaped through-slot of said one-piece, soft, flexible, elongated, and rectangular-parallelepiped-shaped outer shell is closed, and the at least one of the hand straps of the package, the string of the tied package, and the rope of the tied package is prevented from escaping from said shopping package carrying hand grip even after the package has been set down.

2. The grip as defined in claim 1, wherein at least one longitudinal face of said pair of flat, opposing, and parallel longitudinal faces of said one-piece, soft, flexible, elongated, and rectangular has indica disposed thereon.

3. The grip as defined in claim 1, wherein said one-piece, soft, flexible, elongated, and rectangular-parallelepiped-shaped outer shell is resilient plastic type foam.

4. The grip as defined in claim 1, wherein said one-piece, sturdy, inflexible, hollow, and circular-cylindrically-shaped inner tubular member is fixedly attached to said one-piece, soft, flexible, elongated, and rectangular-parallelepiped-shaped outer shell by an adhesive.

5. The grip as defined in claim 1, wherein said one-piece, sturdy, inflexible, hollow, and circular-cylindrically-shaped inner tubular member is fixedly attached to said one-piece, soft, flexible, elongated, and rectangular-parallelepiped-shaped outer shell by ultrasonic techniques.

6. The grip as defined in claim 1, wherein said one-piece, sturdy, inflexible, hollow, and circular-cylindrically-shaped inner tubular member is fixedly attached to said one-piece, soft, flexible, elongated, and rectangular-parallelepiped-shaped outer shell by frictional fit.

* * * * *